United States Patent [19]

Bertagnoli

[11] Patent Number: 4,799,366

[45] Date of Patent: Jan. 24, 1989

[54] KNITTING OR HOSIERY MACHINE WITH ELECTRONIC-CONTROLLED, ELECTROMECHANICALLY ACTUATED SELECTION OF THE NEEDLES

[75] Inventor: Leopoldo Bertagnoli, Brescia, Italy

[73] Assignee: Orizio Paolo S.p.A., Rodengo Saiano, Italy

[21] Appl. No.: 125,570

[22] Filed: Nov. 25, 1987

[30] Foreign Application Priority Data

Aug. 4, 1987 [IT] Italy ..... 21586 A/87

[51] Int. Cl.[4] ..... D04B 9/10

[52] U.S. Cl. ..... 66/219; 66/220

[58] Field of Search ..... 66/215–222

[56] References Cited

U.S. PATENT DOCUMENTS

| | | | |
|---|---|---|---|
| 3,710,594 | 1/1973 | Boureois | 66/220 |
| 3,733,855 | 5/1973 | Bliss-Hill et al. | 66/219 |
| 3,861,173 | 1/1975 | Kinkelin | 66/220 |
| 4,033,148 | 7/1977 | Mureso | 66/220 |

*Primary Examiner*—Ronald Feldbaum
*Attorney, Agent, or Firm*—Robbins & Laramie

[57] ABSTRACT

For a multi-feed knitting machine or hosiery machine, the system of selection of the needles is equipped, per each thread feed, with at least a stationary electromagnetic actuator, suitable for acting by magnetic attraction on wire springs incorporated inside selection sinkers inserted inside the slots under the needles and the needle pushers. An extraction cam extracts the selection sinkers and the needle pushers coupled with them from the slots, in order to bring the heels of the needle pushers to interfere with a lifting cam. A loading cam brings the springs of the sinkers into contact with the face of the actuator, wherein they are retained by magnetic force. A narrow area of the face of the actuator can be demagnetized by impulses emitted by an electronic control system. If this area is demagnetized, the springs of the sinkers are taken by a blanking-out cam, which pushes the sinkers into their relevant slots and the heels of the needle pushers out from the field of action of the lifting cam.

9 Claims, 8 Drawing Sheets

KNITTING OR HOSIERY MACHINE WITH ELECTRONIC-CONTROLLED, ELECTROMECHANICALLY ACTUATED SELECTION OF THE NEEDLES

The present invention relates to a knitting or hosiery machine, with electronic-controlled, electromechanically-actuated selection of the needles.

The invention is indifferently related to circular machines, as well as to flat knitting machines.

It is known that in single-cylinder knitting or hosiery machines, it is necessary to carry out a selection of the needles, viz., decide, in correspondence of each thread feed, whether the needles must work, i.e., whether they must take the new thread, or whether they must remain inactive, i.e., not take the new thread. On certain machines, furthermore a third selection, intermediate between the two above-mentioned selections, is required, i.e., it is necessary to decide whether the needles must retain the old loop and take the new thread (in their so-said "retained loop position").

Mechanically-controlled devices for the selection of the needles are known, which, by means of mechanical selection elements, act on selector elements inserted under the needles inside the slots of the cylinder, or of the needle beds of the machine. These mechanical selection devices, besides being rather complex, make it possible to realize a limited number of patterns, and, above all, on machines with a large number of thread feeds, they cause a considerable complexity in the structure of the machine.

Electronic-controlled, electromechanically-actuated needle selection devices have already been proposed, which devices made it possible to considerably increase the number of patterns which can be realized, simultaneously reducing also the structural complexity. These latter devices are equipped with electromagnetic actuators, operating by means of levers acting on the pattern heels of selection elements capable of only moving in such a way as to re-enter, and exit, the respective slots of the cylinder or of the needle beds, to bring related needle pushers coupled with them, with their heel into engagement, or off engagement with lifting cams. In this case, the selectors are therefore not bound to the lifting and sinking movements of the related needle pushers and needles, whilst the electromagnetic actuators are equipped with a certain number of mobile levers positioned at different levels, corresponding to the levels of pattern heels of the selectors.

In the mechanical selection devices, on the contrary, the selectors, which too are equipped with pattern heels positioned at different levels, are controlled by the mechanical selection elements to carry out also lifting and sinking movements inside their respective slots on the cylinder or on the needle beds.

The purpose of the present invention is to create an electronically-controlled, electromechanically-actuated selection device, with a smaller number of moving elements, and, hence, with a higher reliability, rapidity of response, and with a greater structural simpleness.

In order to achieve this purpose, according to the invention a needle selection device is provided on a knitting or hosiery machine, which is characterized in that it comprises, per each thread feed, with at least a stationary electromagnetic actuator, with an associated extraction cam, load cam and blanking-out cam; and in that, inside the needle-containing slots, it comprises needle selection sinkers with incorporated spring coupled with respective needle pushers, said needle selection sinkers being movable in the radial direction inside their related slots under the action exerted by said extraction cam by acting on a tooth provided on said needle sinkers and under the action exerted by the load cams and by the blanking-out cams acting on their incorporated spring, with said needle pushers, besides being movable in the radial direction, being also movable in the axial direction, inside their relating slots, relatively to the needle sinkers they are coupled with, the stationary electromechanical actuator magnetically acting on the springs incorporated inside the needle sinkers due to the loading by said loading cam and showing, substantially between the loading cam and the blanking-out cam, a narrow area de-magnetizable by means of impulses sent by an electronic control system.

The selection device according to the invention uses hence completely static electromagnetic actuators which do not require any maintenance, i.e., without any moving elements which may undergo wear and/or disturbances in operation, in as much as these actuators are simply constituted by special electromagnets coupled with permanent magnets facing the cylinder or the needle bed of the machine at the level of the free end of the spring incorporated in each selection sinker, and showing two consecutive always magnetic areas, and an intermediate narrow area, also magnetic, but which can be demagnetized. when to the coil of the electromagnet a demagnetizing impulse comes from the electronic control system.

Vice-versa, the selection sinkers with incorporated spring have a reduced mass, are all equal without pattern heels, and can hence be controlled with an extreme rapidity and reliability in a short length of their stroke together with the cylinder or the needle bed inside whose slots they are housed under the needles and the relevant needle pushers. This arrangement makes it possible to carry out more than once, per each thread feed, the selection of the needles, even if said needles have positions in height, inside the slots of the cylinder or of the needle bed, which are different from one another. In such way, e.g., it is possible to carry out, per each thread feed, by means of two successive selections, not only the selection between the needles which must operate and the needles which must not operate, but also the selection between the needles which must retain the loop.

The characteristics of the invention, and the advantages which derive from it will result with a greater clearness from the following disclosure of exemplifying forms of practical embodiment of the same invention, referred to a circular machine equipped with a revolving cylinder and skirt of cams, and with stationary actuators located around the cylinder, as illustrated in the hereto attached drawings, wherein:

FIG. 1 shows a vertical sectional view through the cylinder and the skirt of cams surrounding the cylinder, said section passing along the axis of the same cylinder;

FIG. 1*a* shows a sectional view similar to that of FIG. 1, on an enlarged scale, and limitedly to the lower portion of the cylinder, with a different position of the needle selection sinker and of the needle pusher;

Figure 3:
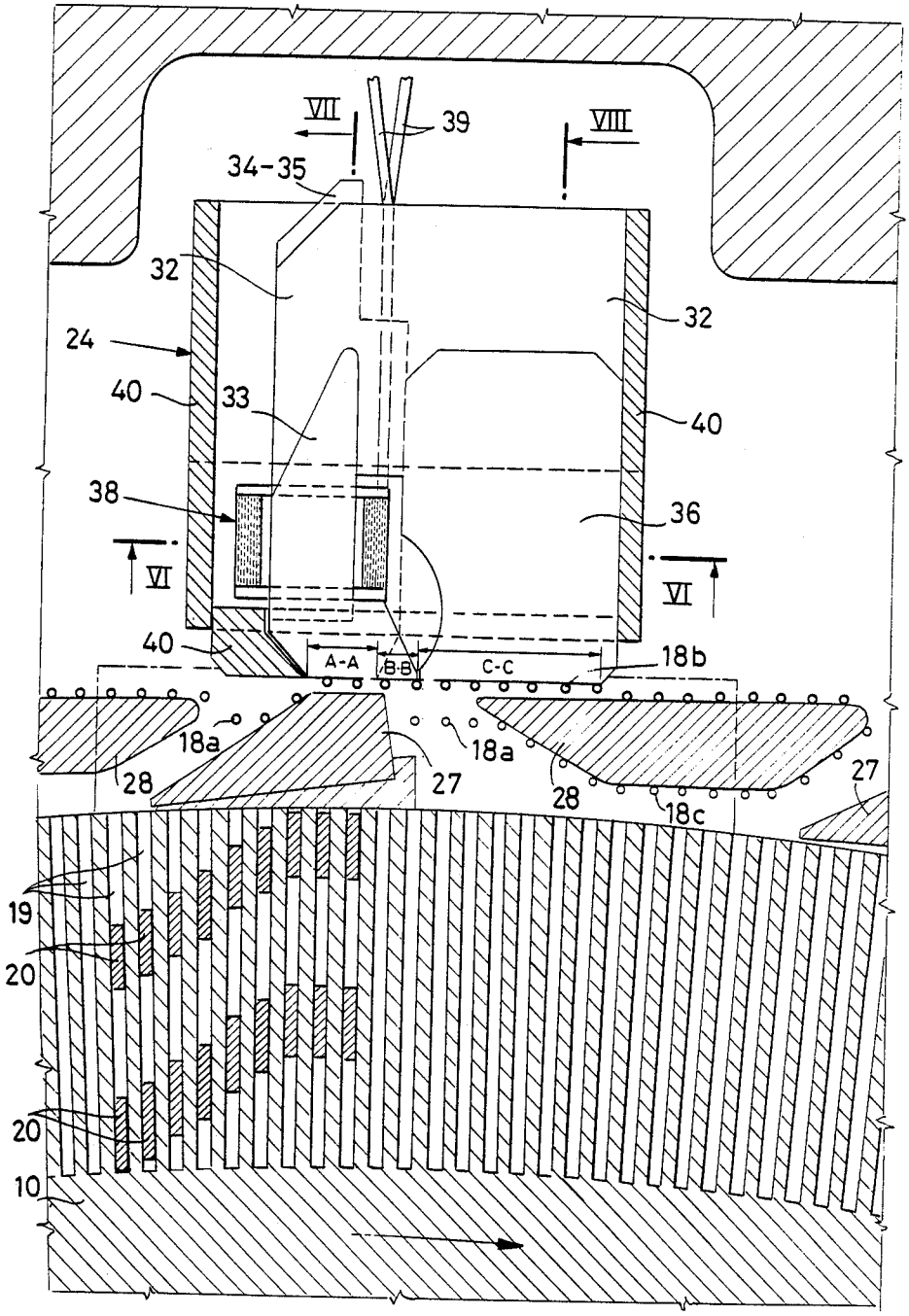
Figure 4:
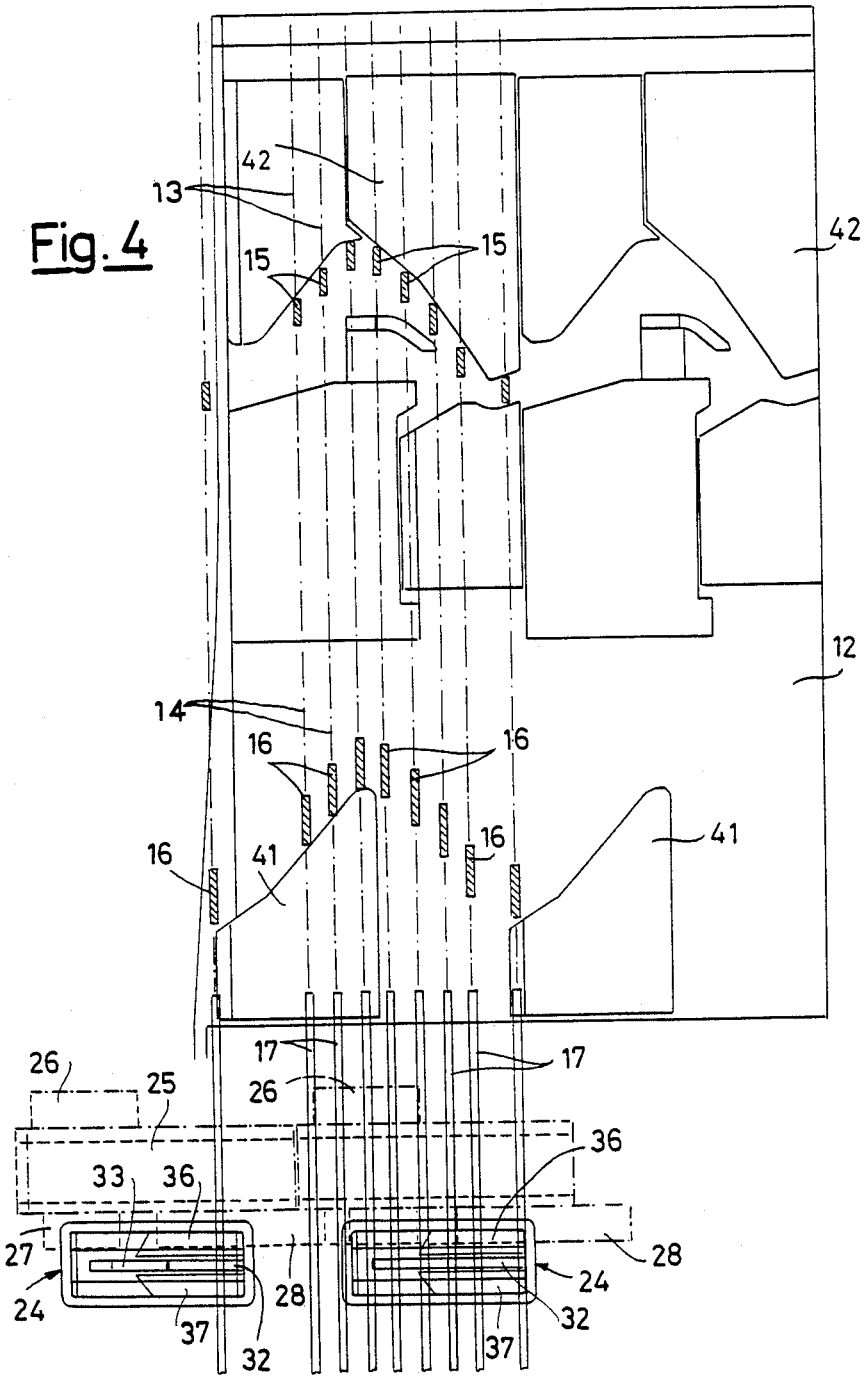
FIG. 4 shows an elevation view of a portion of the skirt of cams and of the actuators, from the interior of the cylinder.
Figure 9:
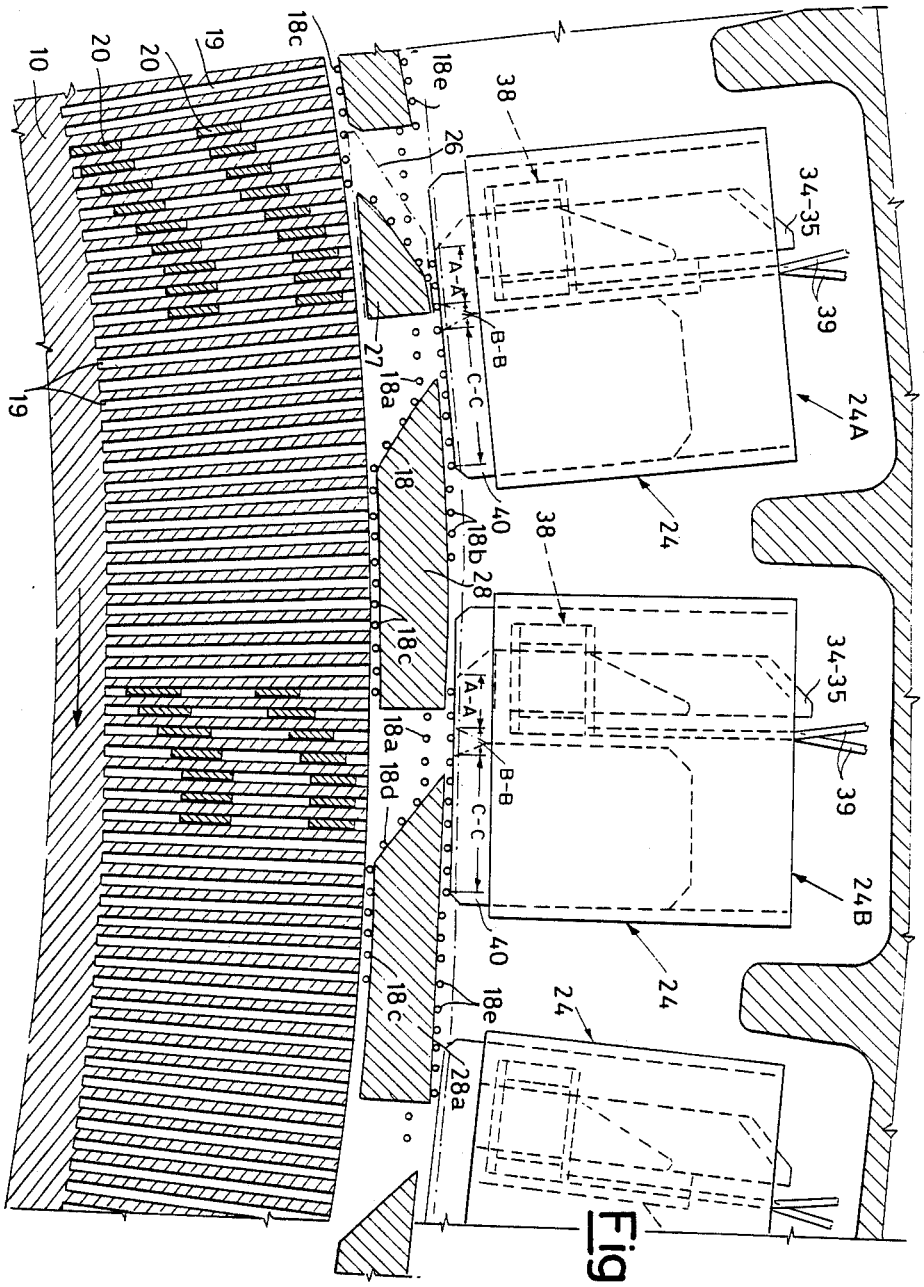
Figure 10:
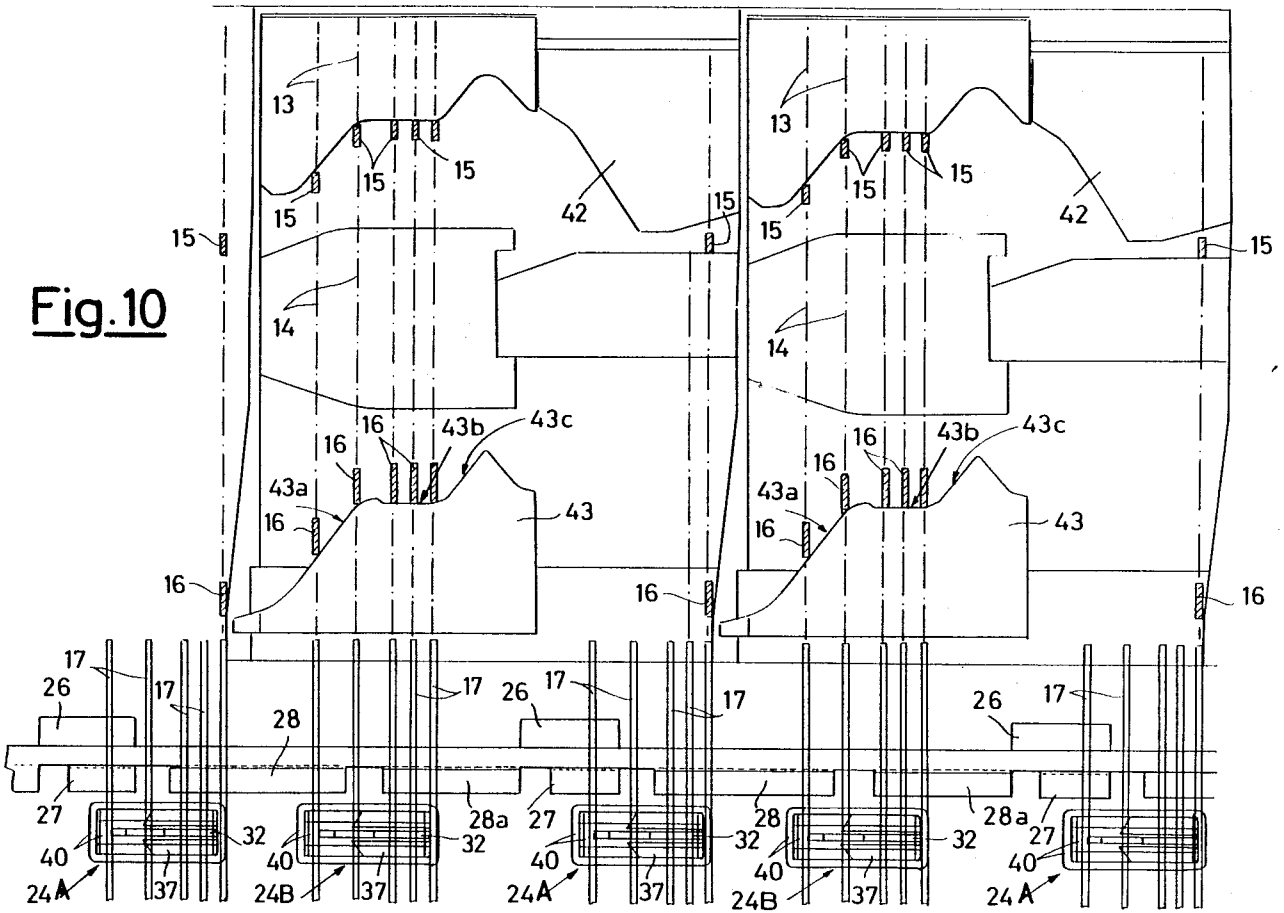

FIGS. from 5 to 8 respectively show a front view, from the interior of the cylinder, and sectional views, according to paths VI—VI, VII—VII, and VIII—VIII of FIG. 3, of the electro magnetic actuator;

FIG. 9 shows a horizontal sectional view analogue to that of FIG. 3, of a variant of practical embodiment, to carry out two successive selections for the same thread feed; and FIG. 10 shows a view analogue to that of FIG. 4, of the cams to carry out the double selection for the same thread feed.

Figure 1:
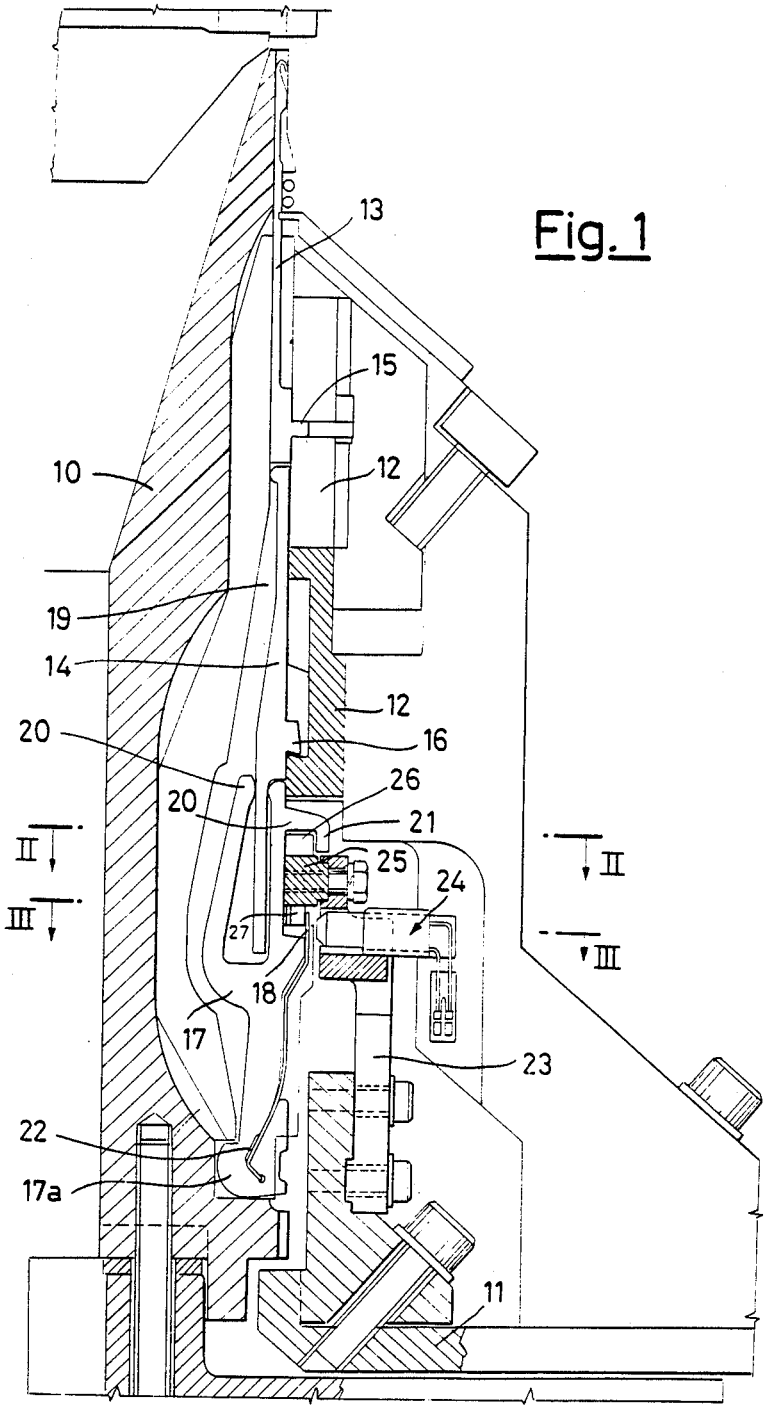
Figure 1A:
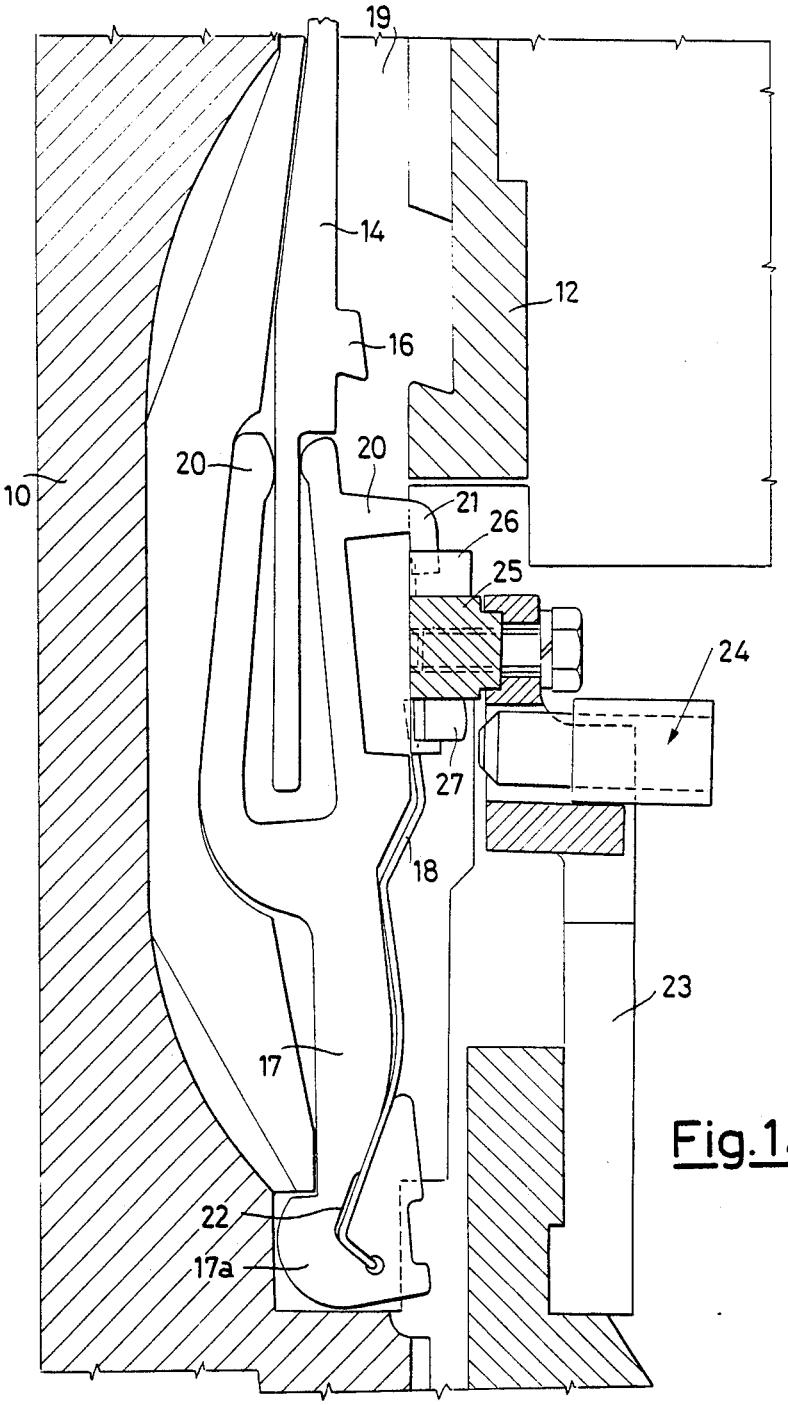

As it can be seen in FIG. 1, in the example taken into consideration, the machine is a single-cylinder circular knitting machine, with a vertical-axis cylinder of the needles 10 (the central axis is on the left-hand side of the figure, and is not visible), supported and driven in a way known from the prior art, such to rotate around its own axis inside a stationary framework 11. Outside the cylinder 10, and surrounding it, the skirt of the cams 12 is provided, which is integral with the framework 11, whose cams are destined to drive the lifting and sinking movements of the needles 13 and of the relevant needle pushers 14, each of them by means of a related heel 15 and respectively 16.. The needles 13 and the needle pushers 14 are inserted inside peripheral parallel vertical slots 19 provided on the cylinder 10. Inside each one of said slots 19, under the relevant needle pusher 14, a needle selection sinker 17 is furthermore provided, which is equipped with an incoporated wire spring 18. The selection sinker 17 has, in its bottom portion, a rounded portion 17a, which acts as the fulcrum around which said selection sinker 17 can swing in a known way. In its upper portion, the selection sinker 17 has a fork-shaped end 20, in correspondence of which said sinker is furthermore provided with a tooth 21, with which extraction cams are suitable for cooperating; said extraction cams are discussed in detail in the following. The needle pusher 14 is with its lower end always in engagement with the upper, fork-shaped end 20 of the selection sinker 17. In its lower portion, the selection sinker 17 is provided with a suitably curved slot 22, inside which the lower, correspondingly bent, end of the wire spring 18 is inserted. On leaving said slot, the spring is then bent such to come to lay in front of the front bent edge (towards the outside of the cylinder) of the sinker 17, and is finally bent to a "Z"-shape in correspondence of its upper free end. When no external forces are applied, the wire spring 18 of ferrous material takes, in front of the front edge of the sinker 17, the position shown in FIGS. 1 and 1*a*.

Figure 2:
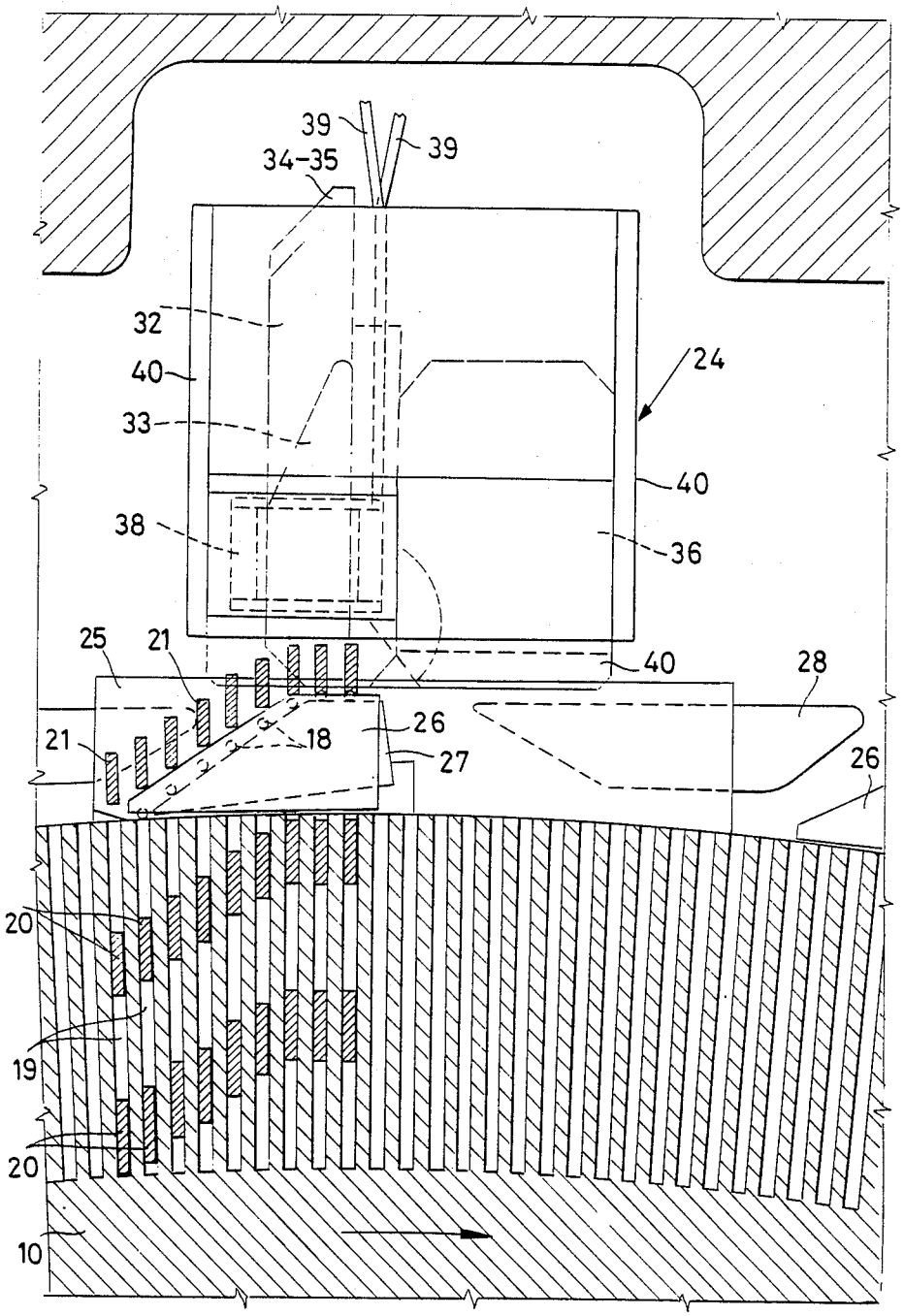
FIGS. 2 and 3 show horizontal sectional views according to paths II—II and III—III of FIG. 1.

In correspondence of each thread feed of the machine, a stationary support 23 is fastened, which holds an electromagnetic actuator 24 and a cam-holder 25, with an upper, extraction, cam 26 and two lower cams, a loading cam 27 and a blanking-out cam 28. The extraction cam 26 is destined to act on the tooth 21 of the selection sinkers 17, to make them rotate around their lower fulchrum 17a and then radially extract them from their slots 19 (see FIG. 2). In such way, also the needle pusher 14 coupled with the selection sinker 17 is extracted, so that its heel 16 can engage on the related lifting cam of the cam skirt 12, as it is disclosed in detail in the following. On the contrary, the cams 27 and 28 are destined to act on the incorporated spring 18 of the sinkers 17 in correspondence of the free end of the same spring (see FIG. 3). These cams 27 and 28 are made of non-magnetic material; with the cam 27, the "loading cam" performing the task of pushing the spring 18 from its neutral position (indicated by the reference numeral 18*a* in FIG. 3), assumed when the relevant sinker 17 has been completely extracted, by the extraction cam 26, against the body of the electromagnetic actuator 24, and the cam 28, the "blanking-out cam", performs the function of pushing the spring 18, and the relevant sinker 17 to re-enter the slot 19 of the cylinder 10, when, due to a commanded temporary de-magnetizing of a narrow area of the electromagnetic actuator 24, the spring 18 has been released by the same actuator, and due to its own spring bias, said spring has returned back to its neutral position (see 18*a*, FIG. 3).

Figure 5:
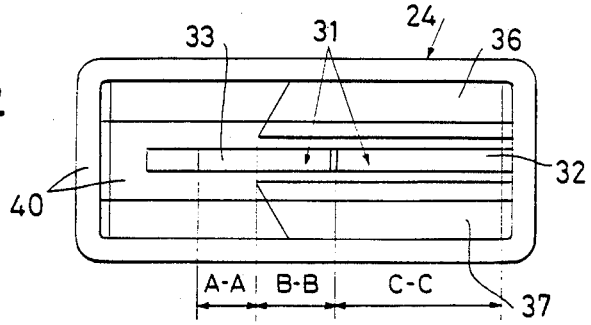
Figure 6:
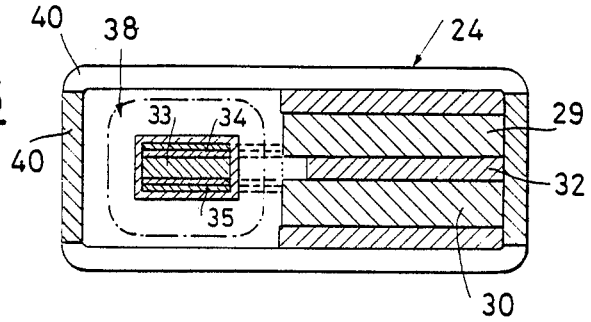
Figure 7:
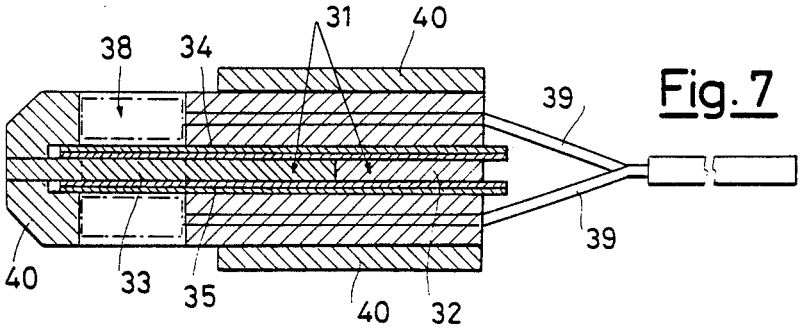

The body of the electromagnetic actuator 24 is positioned under the skirt of cams 12, in a position protected against the dirt, and in front of the cylinder of the needles 10 at the level of the upper, free end of the wire spring 18 of the selection sinkers 17, on a horizontal plane slightly under the horizontal plane on which the loading cams 27 and the blanking-out cams 28 are located (see FIG. 1). The front face of the actuator 24 (plan view, see FIG. 3) extends from the loading cam 27 up to the first portion of the blanking-out cam 28, and said face is provided (see FIGS. 3 and 5) with a first, always magnetic area A—A in correspondence of the spring-loading cam 27, with a magnetic area B—B, which can be de-magnetized on command, substantially extending in correspondence of the beginning of the gap between the loading cam 27 and the blanking-out cam 28, as well as with a C—C, always magnetic, area, which begins before the blanking-out cam 28 and extends up to the first portion of said blanking-out cam.

Figure 8:
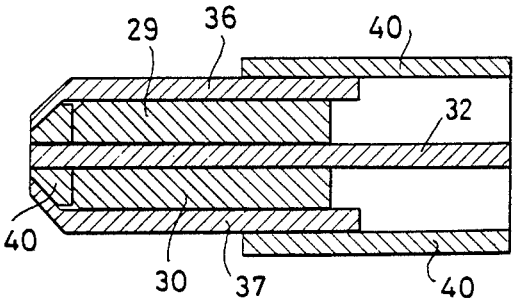

The electromagnetic actuator 24, which can be interchangeable, comprises (see FIGS. 3 and 5 through 8) two permanent magnets 29 and 30, which have the shape of small magnetic plates parallel to, superimposed to, and spaced apart from, each other, and with polarities opposite to each other, i.e., whilst the plate 29 has its north pole atop and its south pole in the bottom, the plate 30 has, on the contrary, its pole south atop, and its north pole in the bottom. Between the two magnetic plates 29 and 30, a central core 31 is inserted in contact with the south poles of said plates, said central core 31 substantially having a horseshoe shape (when seen according to a plan view—see FIG. 3). Due to structural reasons, this central core 31 consists of a first, wider portion 32 inserted between the two magnetic plates 29, 30 and a second, narrower portion 33. Two couples of sheets 34 and 35 partially cover, on the upper side, and, respectively, on the lower side, the portions 32 and 33 of the central core 31, to connect them magnetically. Above the magnetic plate 29 and under the magnetic plate 30, and in contact with them, polar expansions 36 and respectively 37 are positioned, which, in correspondence of the front face of the actuator 24 directed towards the cylinder of the needles 10, are bent such to converge towards each other (see FIG. 8).

These polar expansions 36 and 37 are hence in contact wiht the north poles of the magnetic plates 29 and 30. As it can be seen in FIG. 5, the polar expansions 36 and 37 have, frontally, a width larger than the width of the portion 32 of the central core 31, such to partially superimpose also to the portion 33 of the same core 31. Around this portion 33 of the central core 31 and of the couples of sheets 34 and 35, a coil 38 is located, which is connected, by means of leads 39, with an electronicl control system (not shown in the Figures).

All of the components of the electromechanical actuator are contained inside a suitable casing made of a non-magnetic material, generally indicated by the reference numeral 40.

When the coil 38 is not energized, the front face of the portion 33 of the central core 31 presents the south pole of the magnetic plates, as well as the front face of the portion 32 of the same core, whilst the front faces of the polar expansions 36 and 37 present the north pole. As a consequence, the whole front face of the electromagnetic actuator is capable of exerting an action of magnetic attraction on the wire springs 18 of ferrous material incorporated inside the selection sinkers 17.

When from the electronic control system an energizing impulse is sent to the coil 38 of the actuator 24, this energizing causes the inversion of the polarization of the portion 33 of the central core, so that this latter assumes the north polarization, and thus in the B—B region of superimposition of the polar ends 36 and 37, also of north polary, and of the portion 33 an action is created of magnetic repulsion on the wire spring 18 of the selection sinker 17 which is at that time in contact with said B—B region. In this way, a de-magnetization occurs, the wire spring 18 is no longer attracted, and can return, due to its elasticity, back to its neutral position 18*a*.

In FIG. 4, a portion is shown of the skirt of the cams and of the actuators 24, which surround the needle cylinder, relating to two successive thread feed points. Also the relevant extraction cams 26, loading cams 27 and blanking-out cams 28 are visible.

The skirt of cams substantially comprises, per each thread feed, a lifting cam 41, with which the heels 16 of the needle pushers 14 are destined to cooperate, as well as a sinking cam 42, with which the heels 15 of the needles 13 are destined to cooperate. The other cams and counter-cams visible in FIG. 4 do not directly concern the present invention.

The lifting cam 41 performs the task of making the needle pushers 14 move upwards by means of their heels 16, when the related needles must work. The heels 16 of the needle pushers 14 can cooperate with the profile of the cam 41 when the relevant selection sinkers 17, and, thereby, the same needle pushers 14, are extracted from their relevant slots 19 provided on the cylinder, whilst, when they are inserted inside the slots 19 (see FIG. 1*a*), the heels 16 run before the cam 41, without getting engaged with its profile.

The sinking cam 42 drives back downwards the needles 13 which have worked, and hence also their relevant needle pushers 14.

The selection device disclosed up to now operates as follows.

This selection, as it was already said, makes it possible to decide whether, on a determined thread feed, a needle must be brought to work, i.e., to take the new thread, releasing the previous loop, or whether the needle must remaing inoperative. The selection takes place as follows.

First of all, all of the selection sinkers 17, if they are inserted inside their relevant slots 19, are extracted from the slots 19 of the cylinder 10 by means of the extraction cam 26 acting on the tooth 21 of the same sinkers (see FIGS. 1 and 2), so that the wire spring 18 of the sinkers is brought to a neutral position (indicated by the reference numeral 18*a* in FIG. 3). While the extraction of the selection sinkers 17, and thereby, also of their respective needle pushers 14 coupled with them, is taking place, the loading cam 27 begins to act on the wire springs 18 incorporated in the sinkers, to push them, once that the extraction has occurred, against the front face of the actuator 24 in correspondence of the magnetic region A—A (see FIG. 3), which keeps the springs 18 attracted, and, consequently, the selection sinkers 17 extracted.

Now, the true selection of the needles takes place. If the concerned needle must be sent to work, no demagnetizing impulses are sent by the electronic control system to the coil 38 of the electromagnetic actuator 24, so that the B—B region of its front face retains its magnetic attraction action, and the spring 18 of the selection sinker 17 continues to be attracted also in the narrow B—B area, and subsequently also in the always magnetic C—C area. In such way, the spring 18 is prevented from returning back, due to its elasticity, to its neutral position, and hence it cannot be engaged by the blanking-out cam 28. The selection sinker 17 remains hence extracted from the slot 19 of the cylinder 10 (following the path 18b shown in FIG. 3), and its upper, fork-shaped end 20 keeps extracted the needle pusher 14 too, whose heel 16 gets engaged on the lifting cam 41. The needle pusher 14 brings the needle 13 into its working position, and then the sinking cam 41, acting on the heel 15 of the needle 13, brings the same needle and the needle pusher 14 back downwards, to enable them to start a new cycle in correspondence of the subsequent thread feed.

Vice-versa, if the concerned needle must not be sent to work in correspondence of the thread feed taken into consideration, the electronic control system sends a demagnetizing impulse to the coil 38 of the electromagnetic actuator 24, so that the B—B area of its front face does no longer perform its action of magnetic attraction, and the spring 18 of the selection sinker 17 associated with the concerned needle, after being attracted in the A—A area, is released in the B—B area and returns back, due to its own elasticity, to its neutral position (position 18*a*, see FIG. 3). So, the spring 18 can come into contact with the blanking-out cam 28, which pushes the spring 18 and the same sinker 17 towards the interior of the slot 19 of the cylinder 10 (following the path 18*c* shown in FIG. 3). In such way, also the consequent reentering into the slot of the cylinder is caused of the heel 16 of the needle pusher 14 radially constrained to the upper, fork-shaped end 20 of the selection sinker 17, and the heel 16 of the needle pusher 14 cannot come into engagement on the lifting cam 41, and the relevant needle 13 remains in its lower position, i.e., it remains off-operation.

It should be observed that the B—B area of the front face of the electromagnetic actuator 24 which can be demagnetized on command, and which constitutes the true selection region, has an extension, in the circumferential direction, which is shorter than the distance between two adjacent needles on the cylinder 10, so that it is possible to individually select each needle, by sending, or not sending, de-magnetizing impulses to the coil 38 of the electromagnetic actuator 24, in phase with the revolution of the cylinder of the needles 10. In other words, the command leaving from the electronic control system must be in perfect synchronism with the revolution of the cylinder, and that can be secured by a suitable encoder installed on the machine.

In case of machines which require, besides the selection between needles which must work, and needles which must not work, also an intermediate selection, viz., for needles which must be brought into a retained-loop position, without releasing the preceding loop, and take the new thread in the relevant thread feed, with the same thread feed two consecutive electromagnetic actuators 24A and 24B, identical to each other, must be associated (see FIGS. 9 and 10). Furthermore, also the lifting cam of the needle pushers 14 must have a different outline from that of the relevant cam 41 provided in case of simple selection, and, associated with the second electromagnetic actuator 24B, a supplementary blanking-out cam 28*a* must be provided. In FIG. 9, substantially corresponding to FIG. 3, the two successive actuators 24A and 24B, the extraction cam 26, the spring-loading cam 27 and the two blanking-out cams 28, 28A are visible, which are associated with a thread feed, in which (see FIG. 10), a lifting cam 43 for the heels 16 of the needle pushers 14 is provided which, after a first rising length 43*a* shows a horizontal length 43*b*, followed by a second rising length 43*c*.

The operating way of this variant of practical embodiment of the device of selection of the needles is analogous to that already disclosed for the simple selection.

Before each thread feed, the extraction cam 26 extracts from the slots 19 of the cylinder 10 all of the selection sinkers 17, with their respective needle pushers 14, which arrive in a not-already-extracted condition, and the loading cam 27 pushes the wire springs 18 incorporated in the needle sinkers against the front face of the first actuator 24A in correspondence of its A—A region. If the needle, whose selection sinker 17 with wire spring 18 comes in correspondence of the B—B region of the actuator 24A, must not be sent work, from the electronic control system a de-magnetizing impulse is sent to the coil 38 of the actuator 24A, the spring 18 is released and returns back to its neutral position 18*a*, and the first blanking-out cam 28 pushes the spring 18, together with the relevant sinker 17, towards the interior of the slot 19 of the cylinder 10, so that the spring 18 runs along the path 18*c* (see FIG. 9). The relevant needle pusher 14 is not lifted by the cam 43, and said needle remains off work.

Vice-versa, if the needle in question must be sent to operate, or to retain the loop and take the new thread, to the coil 38 of the actuator 24A the demagnetizing impulse is not sent. The spring 18 and the sinker 17 of such a needle 13 remain extracted from the slot 19 of the cylinder, and the spring 18 runs along the path 18*b* (see FIG. 9). Consequently, the relevant needle pusher 14 gets engaged with its heel 16 on the lifting cam 43, and precisely on the first rising portion 43*a* thereof, which leads the heel 16 of the needle pusher up to the level of the horizontal length 43*b* of the same cam. This partial lifting of the needle pusher 14 leads the relevant needle 13 to its position of retained loop.

If the needle is destined to remain in such position in the concerned thread feed, the wire spring 18 of its selection sinker 17, when coming in correspondence of the A—A region of the second actuator 24B associated with this thread feed, wherein also the first blanking-out cam 28 ends, must be released in the following B—B area of the second actuator 24B. Therefore, to the coil 38 of the second actuator a de-magnetizing impulse must be sent, which makes it possible the spring 18 to return back to its neutral position 18*a*, and the second blanking-out cam 28A pushes the spring, and its sinker, towards the interior of the slot 19 of the cylinder 10, making the spring 18 run along the path 18*d*, which leads it to the path 18*c*. In such way, the heel 16 of the needle pusher 14 cannot engage the second rising length 43*c* of the cam 43, and the needle remains in its position of retained loop.

If the needle must be sent to work, on the contrary, to the coil 38 of the second actuator 24B the demagnetizing impulse is not sent, so that the spring 18 of the selection sinker 17 remains attracted inside the B—B and C—C regions of the second actuator 24B, running along the path 18*e*. In such way, also the relevant needle pusher 14 remains extracted, and its heel 16 can engage the second rising length 43*c* of the cam 43, thus sending the needle to work. Then, the sinking cam 42 drives downwards the needle which has worked, together with its relevant needle pusher.

The present invention has been disclosed by referring to a circular knitting machine with a revolving cylinder and a skirt of cams and stationary actuators. It is understood however that it is applicable also to single-bed or double-bed flat knitting machines, provided with reciprocating rectilinear movements. Furthermore, the invention can be applied also to knitting machines wherein the cylinder or the needle beds are stationary, and, on the contrary, the cams and the actuators carrying out the needle control and selection are movable.

I claim:

1. Knitting machine comprising (a) a holder component provided with a plurality of parallel slots, each of said slots receiving therein a needle, a needle pusher and a selection sinker, said selection sinker being coupled with said needle pusher for movement together with said needle pusher, perpendicularly to said slot, said needle and needle pusher being coupled for longitudinal movement inside the slot; (b) a support component needle and needle pusher control cams supported by the support component, the support component including a needle pusher lifting cam and a needle sinking cam; and (c) an electromechanical actuator for acting on the selection sinker; said needle, needle pusher selection sinker, said needle pusher control cams and electromechanical actuator being controlled to mutually move, the knitting machine being provided with a plurality of thread feed points, a stationary electromechanical actuator for each thread feed, said electromagentical actuator being associated with an extraction cam, a loading cam and a blanking-out cam, said selection sinker being equipped with an incorporated spring of ferrous material and said extraction cam being configured to act on a tooth formed along said selection sinker for extracting the selection sinker from its slot, said loading and blanking-out cams being arranged to act on the spring incorporated in the selection sinker, the electromagnetic actuator further including a demagnetizable region positioned between the loading cam and the blanking-out cam for selectively acting on the springs of the sinkers following the loading by said loading cam in accordance with signal input from an electronic control system.

2. Knitting machine according to claim 1, characterized in that the electromagnetic actuator comprises permanent magnets with polar expansions, as well as a coil which can be energized by impulses coming from said electronic control system, said permanent magnets, polar expansions and coil being incorporated inside a casing of a non-magnetic material having a front face facing the slots of the component holding the needles, needle pushers and selection sinkers at the level of the ends of the spring incorporated in the selection sinkers, on a plane between the plane containing the loading cams and the blanking-out cams, with said polar expansions emerging in correspondence of said front face of the casing forming a first, always magnetic region, a second, narrow, de-magnetizable region, and a third, always magnetic, region.

3. Knitting machine according to claim 2, characterized in that said de-magnetizable region has a width shorter than the distance between two adjacent slots on the needle, needle pusher and selection sinker holder component.

4. Knitting machine according to claim 3, characterized in that per each thread feed, two successive identical electromagnetic actuators are provided, with the first of which the extraction cam, the loading cam and a first blanking-out cam are associated, whilst with the second electromagnetic actuator a second blanking-out cam, also destined to act on the springs incorporated in the selection sinkers, is associated, with the narrow de-magnetizable region of the second electromagnetic actuator being substantially positioned between the two blanking-out cams, and that the lifting cam for the needle pushers shows two distinct rising lengths and, between said rising length, a horizontal length.

5. Knitting machine according to claim 2, characterized in that said needle, needle pusher and selection sinker holder component is a cylinder, and said component holding the control cams is a skirt surrounding said cylinder.

6. Knitting machine according to claim 4, characterized in that said cylinder is driven to revolve around its axis, and that said skirt is stationary.

7. Knitting machine according to claim 4, characterized in that said skirt is driven to revolve, and said cylinder is stationary.

8. Knitting or hosiery machine according to claim 1, characterized in that said needle, needle pusher and selection sinker holder component is a stationary frame, and said component holding the control cams is movable with respect to the cambox.

9. Knitting or hosiery machine according to claim 6 characterized in that at each thread feed the actuator with relevant extraction cams, loading cams and blanking-out cams is supported by a support fastened onto the framework under the skirt of the control cams.

* * * * *